US005876091A

United States Patent [19]

Chernomashentsev

[11] Patent Number: 5,876,091

[45] Date of Patent: Mar. 2, 1999

[54] COLLAPSIBLE TRIPOD STOOL

[76] Inventor: Alan Chernomashentsev, CMR 414 Box 1455, APO AE 09173, Burglengenfeld, Germany

[21] Appl. No.: 820,638

[22] Filed: Mar. 15, 1997

[51] Int. Cl.[6] ..... A47C 4/00; A47C 5/10

[52] U.S. Cl. ..... 297/16.2; 297/18; 297/182; 297/451.2; 224/155; 248/431; 248/436; 4/484

[58] Field of Search ..... 297/16.1, 16.2, 297/18, 17, 451.2, 344.18, 338, 182; 224/153, 155; 248/431, 436, 177.1; 4/484

[56] References Cited

U.S. PATENT DOCUMENTS

| | | | |
|---|---|---|---|
| 478,233 | 7/1892 | Hewitt | 297/18 |
| 587,391 | 8/1897 | Gandy | 297/18 |
| 617,661 | 1/1899 | Smith | 297/18 |
| 1,481,521 | 1/1924 | Marsh | 297/18 X |
| 3,124,387 | 3/1964 | Maclaren | 297/16.2 |
| 5,494,333 | 2/1996 | Wilson | 297/344.18 |
| 5,570,829 | 11/1996 | Harrison | 224/155 X |

FOREIGN PATENT DOCUMENTS

| | | | |
|---|---|---|---|
| 192827 | 12/1907 | Germany | 248/431 X |
| 459059 | 4/1928 | Germany | 248/431 X |

*Primary Examiner*—Peter M. Cuomo
*Assistant Examiner*—Anthony D. Barfield
*Attorney, Agent, or Firm*—Micheal I. Kroll

[57] ABSTRACT

A collapsible tripod stool (16) which comprises three legs (18) with a structure (20) for crisscrossing the legs (18) together. A flexible seat (22) is also provided. A facility (24) is for attaching the flexible seat (22) onto flattened curved top ends (26) of the legs (18). When the legs (18) with the flexible seat (22) are put in an open position and placed upon the ground (28), a person (30) can sit upon the flexible seat (22). When the legs (18) with the flexible seat (22) are put in a closed position, the person (30) can comfortably carry it anywhere for any kind of outdoor activity.

21 Claims, 4 Drawing Sheets

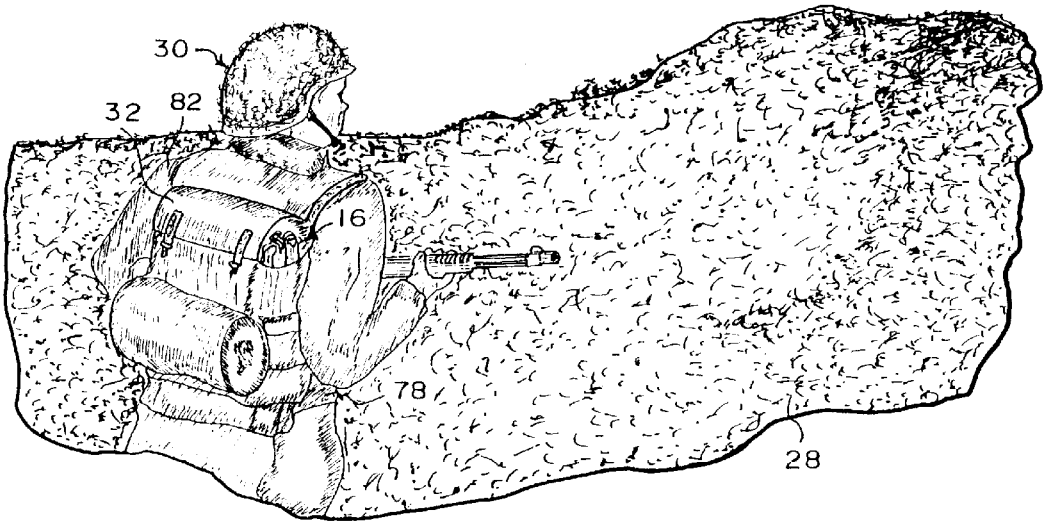
Fig. 1
Fig. 2
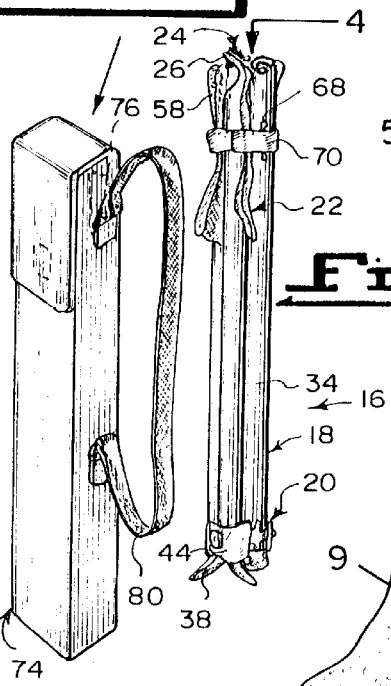
Fig. 2a
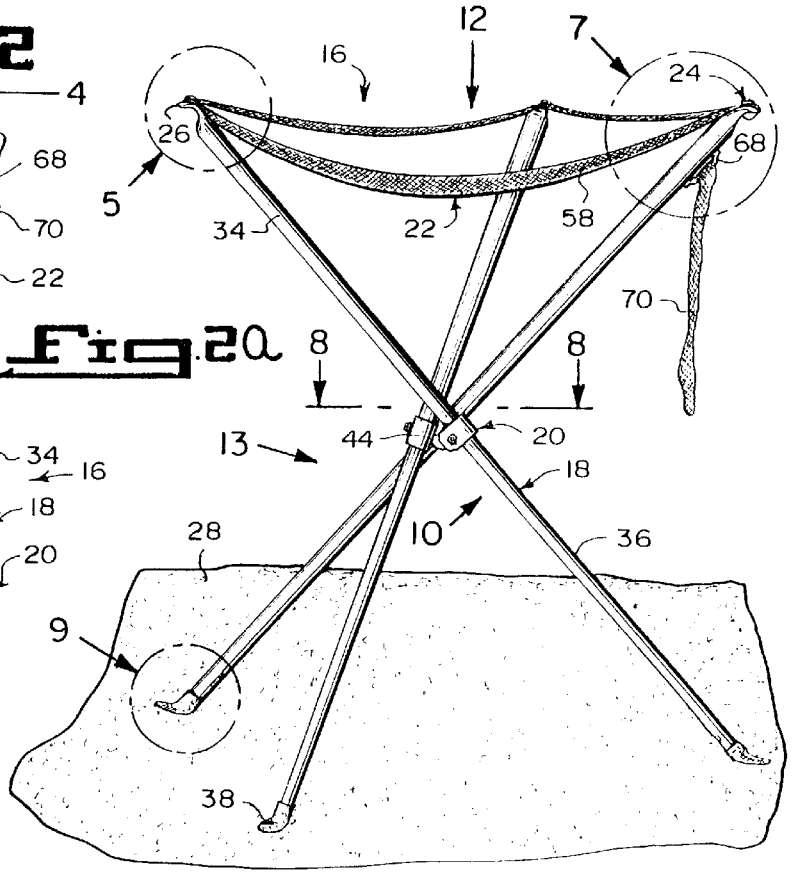
Fig. 3

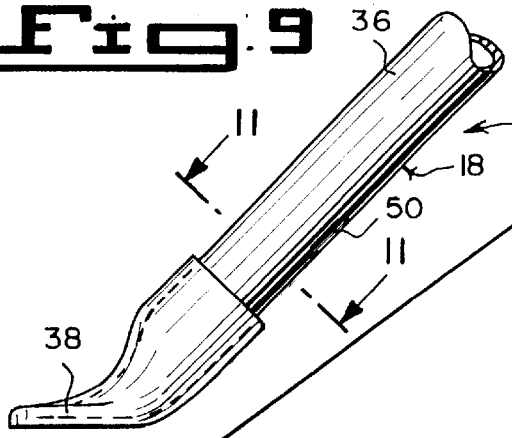
Fig. 9
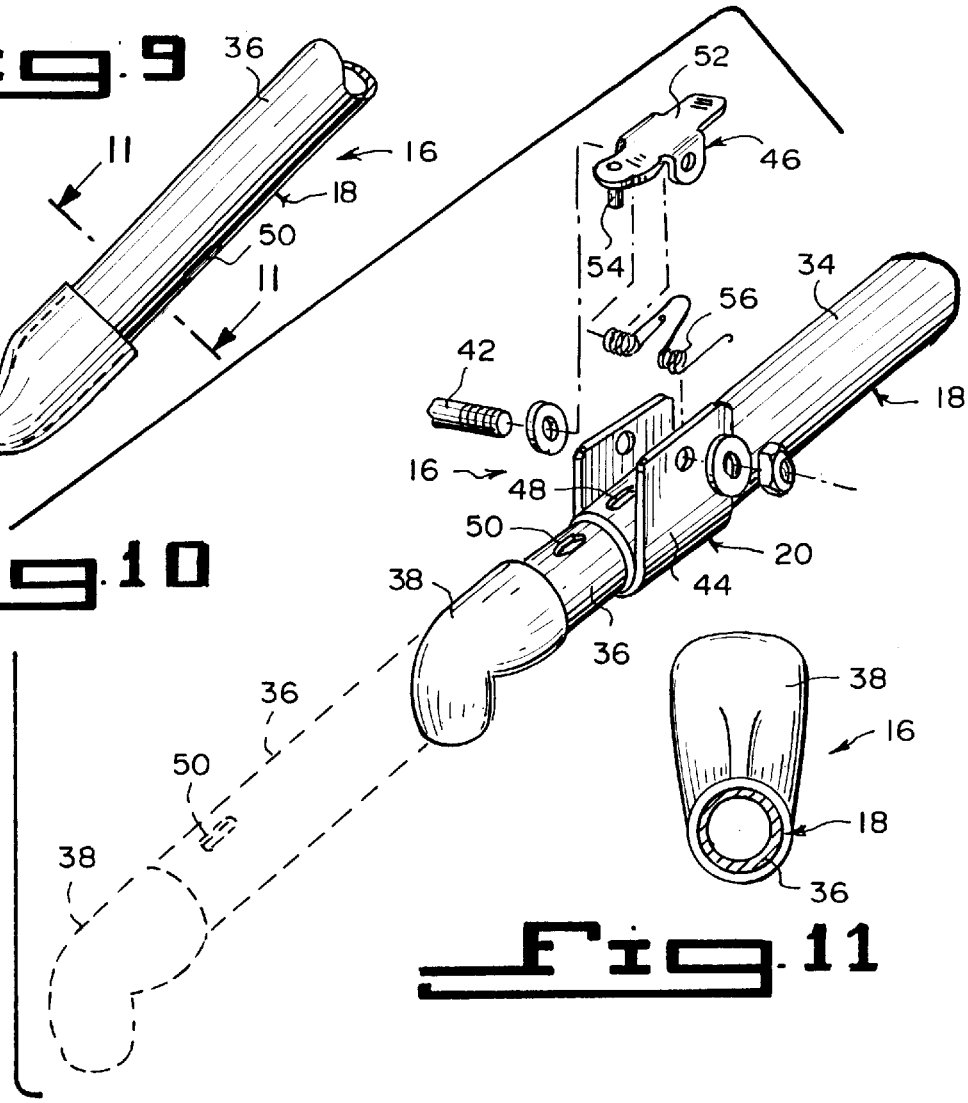
Fig. 10
Fig. 11
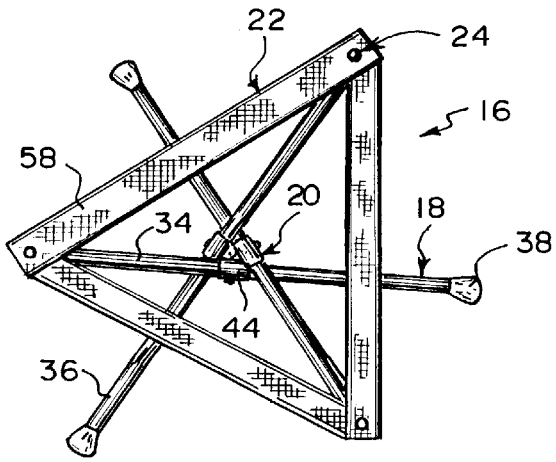
Fig. 12

COLLAPSIBLE TRIPOD STOOL

BACKGROUND OF THE INVENTION

1. Field of the Invention

The instant invention relates generally to camping equipment and more specifically it relates to a collapsible tripod stool. The collapsible tripod stool can be folded up, so that it can be comfortably carried anywhere for any kind of outdoor activity.

2. Description of the Prior Art

Numerous camping equipment have been provided in prior art that are adapted to be utilized by people, such as soldiers, who are temporarily lodged in places having tents, huts or other makeshift shelters. While these units may be suitable for the particular purpose to which they address, they would not be as suitable for the purposes of the present invention as heretofore described.

SUMMARY OF THE INVENTION

A primary object of the present invention is to provide a collapsible tripod stool that will overcome the shortcomings of the prior art devices.

Another object is to provide a collapsible tripod stool that can be folded up, is lightweight and compact, so that it can be comfortably carried, such as in a knapsack of a soldier, anywhere for any kind of outdoor activity.

An additional object is to provide a collapsible tripod stool that can be used in conjunction with a plastic bag, whereby it can be converted into a field toilet.

A further object is to provide a collapsible tripod stool that is simple and easy to use.

A still further object is to provide a collapsible tripod stool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view, showing the instant invention in a folded position and carried in a knapsack of a soldier.

FIG. 2 is a perspective view of a separate carrying case for the instant invention when placed in the folded position.

FIG. 2*a* is a perspective view of the instant invention per se in the folded position.

FIG. 3 is a perspective view of the instant invention in a open position on the ground.

Figure 4:
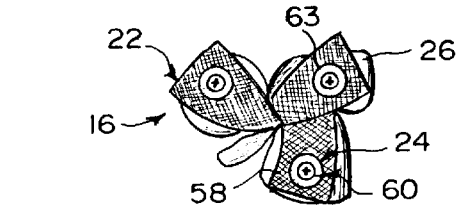

FIG. 4 is an enlarged top view taken in the direction of arrow 4 in FIG. 2*a*.

Figure 5:
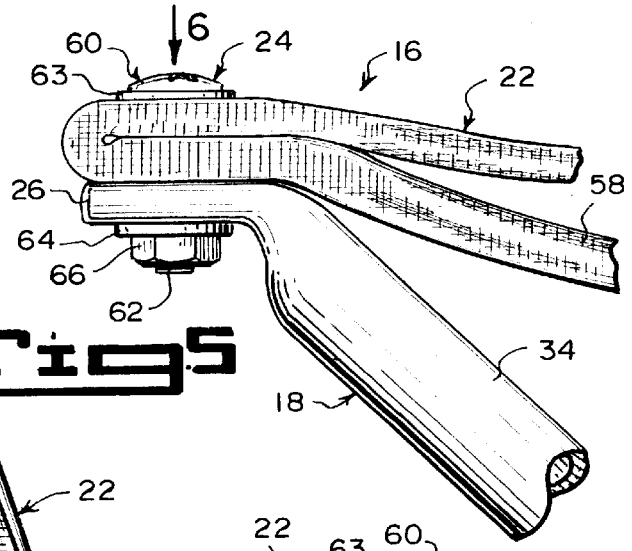

FIG. 5 is an enlarged elevational view of the area indicated by arrow 5 in FIG. 3.

Figure 6:
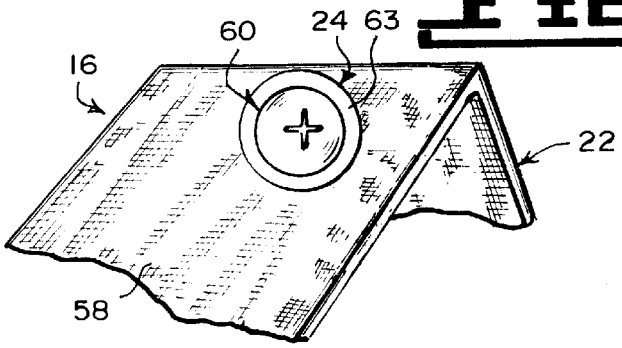

FIG. 6 is a top view taken in the direction of arrow 6 in FIG. 5.

Figure 7:
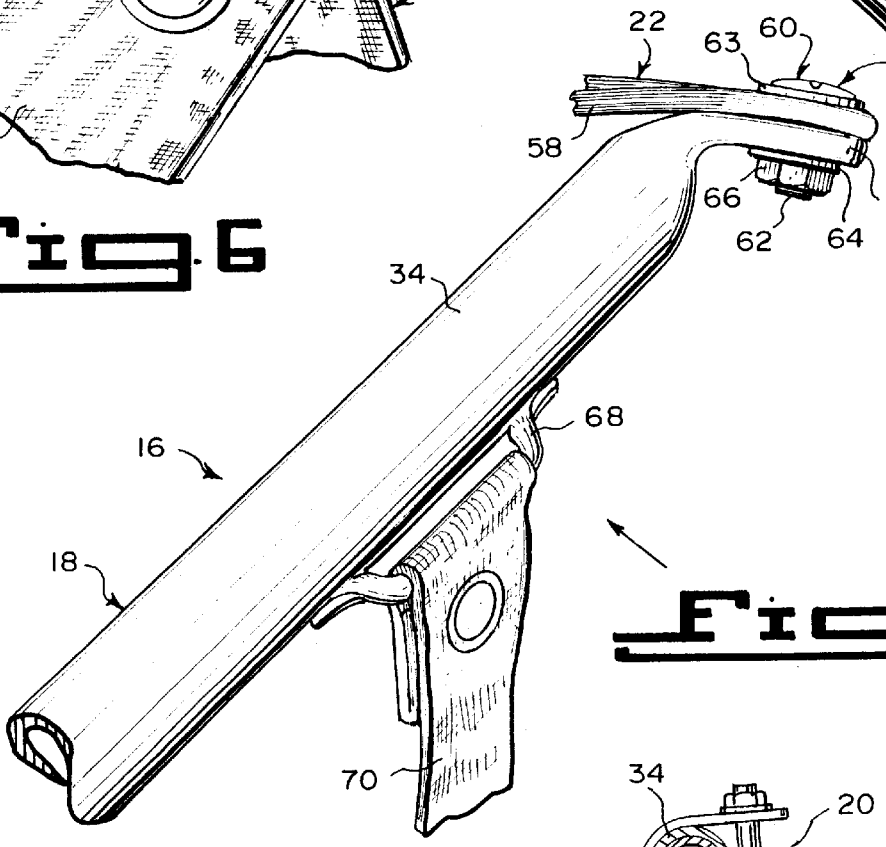

FIG. 7 is an enlarged perspective view of the area indicated by arrow 7 in FIG. 3.

Figure 8:
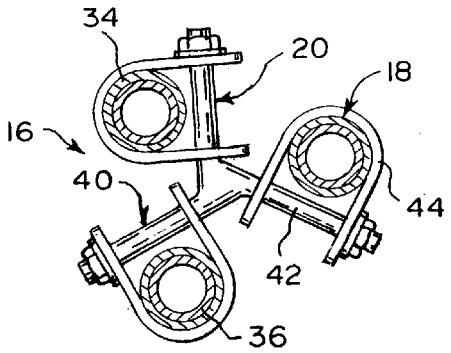

FIG. 8 is an enlarged cross sectional view taken along line 8—8 in FIG. 3.

FIG. 9 is an enlarged elevational view of the area indicated by arrow 9 in FIG. 3.

FIG. 10 is an enlarged partly exploded perspective view taken in the direction of arrow 10 in FIG. 3, showing one of the leg adjustment locking mechanisms thereof.

FIG. 11 is a cross sectional view taken along line 11—11 in FIG. 9.

FIG. 12 is a top view taken in the direction of arrow 12 in FIG. 3.

Figure 13:
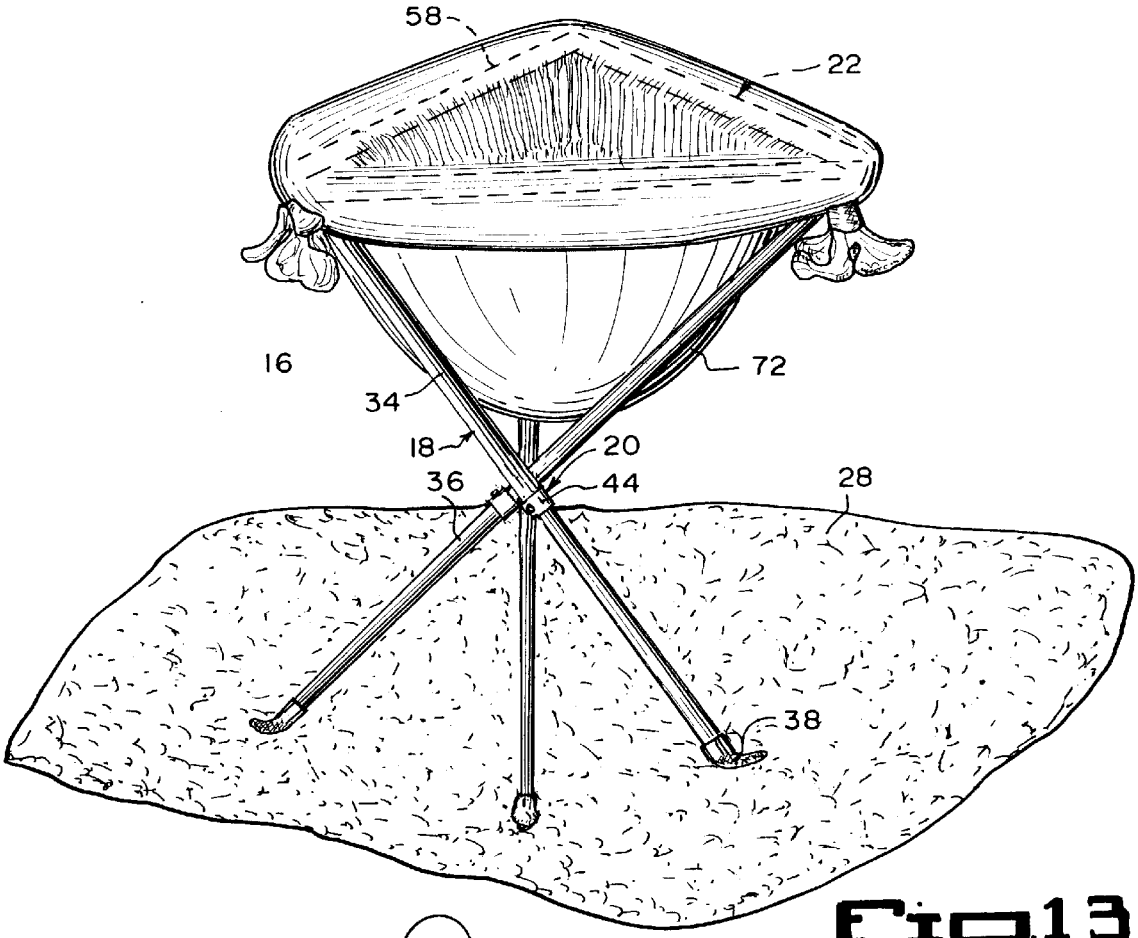

FIG. 13 is a perspective view taken in the direction of arrow 13 in FIG. 3, showing a plastic bag thereon, so as to convert it into a field toilet.

Figure 14:
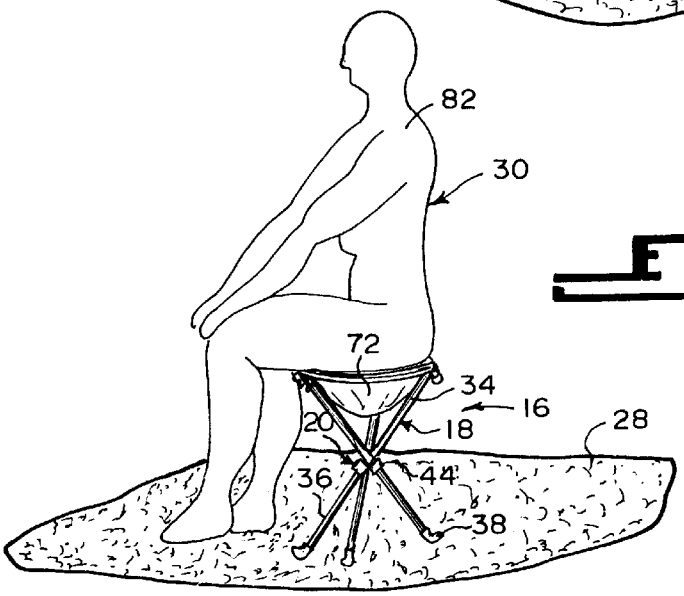

FIG. 14 is a perspective view, showing a person sitting on fop of the plastic bag on the instant invention, using it as a field toilet.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 and 2*a* through 14 illustrate a collapsible tripod stool 16 which comprises three legs 18 with a structure 20 for crisscrossing the legs 18 together. A flexible seat 22 is also provided. A facility 24 is for attaching the flexible seat 22 onto flattened curved top ends 26 of the legs 18. When the legs 18 with the flexible seat 22 are put in an open position and placed upon the ground 28, a person 30 can sit upon the flexible seat 22, as shown in FIG. 3. When the legs 18 with the flexible seat 22 are put in a closed position, the person 30 can comfortably carry it anywhere for any kind of outdoor activity. The person 30 can be a soldier with the collapsible tripod stool 16 carried within a knapsack 32, as shown in FIG. 1.

Each leg 18 is telescopic and includes an upper cylindrical segment 34 and a lower cylindrical segment 36 sized to slide fit within the upper cylindrical segment 34. Each leg 18 also includes a flattened curved foot 38 on a bottom end for extra stability when placed upon the ground 28.

The crisscrossing structure 20, as best seen in FIG. 8, consists of a Y-shaped axle 40 having three arms 42. Three U-shaped brackets 44 are provided. Each U-shaped bracket 44 is secured upon one of the arms 42 of the Y-shaped axle 40 and fits about one upper cylindrical segment 34 of one leg 18.

Each leg 18 contains a locking mechanism 46 to retain the lower cylindrical segment 36 in an extended condition and a retracted condition with respect to the upper cylindrical segment 34. Each locking mechanism 46, as best seen in FIG. 10, includes the upper cylindrical segment 34 of one leg 18 having an aperture 48 adjacent a lower end at the U-shaped bracket 44. The lower cylindrical segment 36 of the leg 18 has two holes 50. The first hole 50 is located adjacent the bottom end, while the second hole is located adjacent a top end (not shown).

A lever 52 is pivotally mounted on one arm 42 of the Y-shaped axle 40. A pin 54 is on the lever 52 to extend through the aperture 48 in the upper cylindrical segment 34 and into any one of the holes 50 in the lower cylindrical segment 36 of the leg 18. A spring 56 on the arm 42 of the Y-shaped axle 40 is to normally bias the lever 52, so that the pin 54 will enter the aperture 48 in the upper cylindrical segment 34 and into one of the holes 50 in the lower cylindrical segment 36 of the leg 18 until the lever 52 is manually depressed to overcome pressure of the spring 56 on the lever 52.

The flexible seat 22 is an elongated belt 58 extending in equal lengths between the flattened curved top ends 38 of the legs 18 in a generally triangular configuration. The attaching facility 24, as best seen in FIGS. 5, 6 and 7, consists of three bolts 60. A threaded shank 62 of each bolt 60 extends through the elongated belt 58 and one flattened curved top end 26 of one leg 18. A first set of three washers 63 are provided. Each washer 63 fits onto the threaded shank 62 of one bolt 60 above the elongated belt 58. A second set of three washers 64 are also provided. Each washer 64 fits onto the threaded shank 62 of one bolt 60, below the flattened curved top end 26 of one leg 18. Three nuts 66 are also provided. Each nut 66 is threaded onto the threaded shank 62 of one bolt 60 below one washer 64.

As shown in FIGS. 2*a*, 3 and 7, a loop 68 can be secured onto one upper cylindrical segment 34 of one leg 18. A band 70 extending from the loop 68 will wrap about all of the upper cylindrical segments 34 of the legs 18, when in the closed position.

The collapsible tripod stool 16, shown in FIGS. 13 and 14, can further include a plastic bag 72 inserted in a space between the generally triangular configuration of the elongated belt 58. Top ends of the plastic bag 72 can be folded over the elongated belt 58 and tied down upon the flattened curved top ends 26 of the legs 18, to convert the collapsible tripod stool 16 into a field toilet, allowing a person 30 to sit upon the plastic bag 72 and use it to urinate and defecate in.

A carrying case 74 is shown in FIG. 2, to hold the collapsible tripod stool 16 therein when placed into the closed position. A loop 76 is attached to the carrying case 74, so that a person 30 can wear said carrying case 74 on a waist belt 78. A shoulder strap 80 is also attached to the carrying case 74 so that a person 30 can support the carrying case 74 from a shoulder 82.

LIST OF REFERENCE NUMBERS

| | |
|---|---|
| 16 | collapsible tripod stool |
| 18 | leg of 16 |
| 20 | crisscrossing structure of 16 |
| 22 | flexible seat of 16 |
| 24 | attaching facility of 16 |
| 26 | flattened curved top end of 18 |
| 28 | ground |
| 30 | person |
| 32 | knapsack on 30 |
| 34 | upper cylindrical segment of 18 |
| 36 | lower cylindrical segment of 18 |
| 38 | flattened curved foot on 18 |
| 40 | Y-shaped axle of 20 |
| 42 | arm of 40 |
| 44 | U-shaped bracket of 20 |
| 46 | locking mechanism for 18 |
| 48 | aperture in 34 |
| 50 | hole in 36 |
| 52 | lever of 46 |
| 54 | pin of 46 on 52 |
| 56 | spring of 46 |
| 58 | elongated belt for 22 |
| 60 | bolt of 24 |

-continued

| | |
|---|---|
| 62 | threaded shank of 60 |
| 63 | washer of 24 |
| 64 | washer of 24 |
| 66 | nut of 24 |
| 68 | loop on 34 |
| 70 | band on 68 |
| 72 | plastic bag on 58 |
| 74 | carrying case for 16 |
| 76 | loop on 74 |
| 78 | waist belt on 30 for 76 |
| 80 | shoulder strap on 74 |
| 82 | shoulder of 30 for 80 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A collapsible tripod stool comprising:

a) three legs each having a flattened curved top end;

b) means for crisscrossing said legs together;

c) a flexible seat including an elongated belt extending in equal lengths between each of said flattened curved top ends of said three legs in a generally triangular configuration; and d) means for attaching said flexible seat onto each of said flattened curved top ends of said legs, so that when said legs with said flexible seat are put in an open position and placed upon the ground a person can sit upon said flexible seat and when said legs with said flexible seat are put in a closed position, the person can comfortably carry it anywhere for any kind of outdoor activity and further including a plastic bag inserted in a space between the generally triangular configuration of said elongated belt, so that top ends of said plastic bag can be folded over said elongated belt and tied down upon said flattened curved top ends of said legs, to convert said collapsible tripod stool into a field toilet, allowing a person to sit upon said plastic bag and use it to urinate and deficate in.

2. A collapsible tripod stool as recited in claim 1, wherein each said leg is telescopic and includes:

a) an upper cylindrical segment; and b) a lower cylindrical segment sized to slide fit within said upper cylindrical segment.

3. A collapsible tripod stool as recited in claim 2, wherein said crisscrossing means includes:

a) a Y-shaped axle having three arms; and b) three U-shaped brackets, in which each said U-shaped bracket is secured upon one of said arms of said Y-shaped axle and fits about one said upper cylindrical segment of one said leg.

4. A collapsible tripod stool as recited in claim 3, wherein each said leg includes a locking mechanism to retain said lower cylindrical segment in an extended condition and a retracted condition with respect to said upper cylindrical segment.

5. A collapsible tripod stool as recited in claim 4, wherein each said locking mechanism includes:

a) said upper cylindrical segment of one of said legs having an aperture adjacent a lower end at said U-shaped bracket;

b) said lower cylindrical segment of one of said legs having two holes, in which said first hole is located adjacent a bottom end, while said second hole is located adjacent a top end;

c) a lever pivotally mounted on one arm of said Y-shaped axle;

d) a pin on said lever extending through said aperture in said upper cylindrical segment and into one of said first and second holes in said lower cylindrical segment of said respective one of said three legs; and e) a spring on one of said three arms of said Y-shaped axle for normally biasing said lever, so that said pin will enter said aperture in said upper cylindrical segment and into one of said holes in said lower cylindrical segment of said respective one of said three legs until said lever is manually depressed to overcome a pressure of said spring on said lever.

6. A collapsible tripod stool as recited in claim 2, further including:

a) a loop secured onto one said upper cylindrical segment of one of said legs; and b) a band extending from said loop which will wrap about all of said upper cylindrical segments of said legs when in the closed position.

7. A collapsible tripod stool as recited in claim 2, wherein each said leg includes a flattened curved foot on a bottom end for extra stability when placed upon the ground.

8. A collapsible tripod stool as recited in claim 7, wherein said crisscrossing means includes:

a) a Y-shaped axle having three arms; and b) three U-shaped brackets, in which each said U-shaped bracket is secured upon one of said arms of said Y-shaped axle and fits about one said upper cylindrical segment of one of said legs.

9. A collapsible tripod stool as recited in claim 8, herein each said leg includes a locking mechanism to retain said lower cylindrical segment in an extended condition and a retracted condition with respect to said upper cylindrical segment.

10. A collapsible tripod stool as recited in claim 9, wherein each said locking mechanism includes:

a) said upper cylindrical segment of one of said legs having an aperture adjacent a lower end at said U-shaped bracket;

b) said lower cylindrical segment of one of said legs having two holes, in which said first hole is located adjacent said bottom end, while said second hole is located adjacent a top end;

c) a lever pivotally mounted on one arm of said Y-shaped axle;

d) a pin on said lever extending through said aperture in said upper cylindrical segment and into one of said first and second holes in said lower cylindrical segment of said respective one of said three legs; and e) a spring on one of said three arms of said Y-shaped axle for normally biasing said lever, so that said pin will enter said aperture in said upper cylindrical segment and into one of said holes in said lower cylindrical segment of said respective one of said three legs until said lever is manually depressed to overcome a pressure of said spring on said lever.

11. A collapsible tripod stool as recited in claim 10, wherein said attaching means includes:

a) three bolts, in which a threaded shank of each said bolt extends through said elongated belt and one said flattened curved top end of one of said three legs;

b) a first set of three washers, in which each said washer fits onto said threaded shank of a respective one of said three bolts above said elongated belt;

c) a second set of three washers each said washer fits onto said threaded shank of a respective one of said three bolts below said flattened curved top end of a respective one of said three legs; and d) three nuts, in which each said nut is threaded onto said threaded shank of a respective one of said three bolts below a respective one of said second set of washers.

12. A collapsible tripod stool as recited in claim 11, further including:

a) a loop secured onto one said upper cylindrical segment of one of said legs; and b) a band extending from said loop which will wrap about all of said upper cylindrical segments of said legs when in the closed position.

13. A collapsible tripod stool as recited in claim 12, further including a carrying case to hold said collapsible tripod stool therein when placed into the closed position.

14. A collapsible tripod stool as recited in claim 13, further including a loop attached to said carrying case, so that a person can wear said carrying case on a waist belt.

15. A collapsible tripod stool as recited in claim 14, further including a shoulder strap attached to said carrying case, so that a person can support said carrying case from a shoulder.

16. A collapsible tripod stool as recited in claim 1, wherein each said leg includes a flattened curved foot on a bottom end for extra stability when placed upon the ground.

17. A collapsible tripod stool as recited in claim 1, wherein said attaching means includes:

a) three bolts, in which a threaded shank of each said bolt extends through said elongated belt and one said flattened curved top end of one of said three legs;

b) a first set of three washers, in which each said washer fits onto said threaded shank of a respective one of said three bolts above said elongated belt;

c) a second set of three washers each said washer fits onto said threaded shank of a respective one of said three bolts below said flattened curved top end of a respective one of said three legs; and d) three nuts, in which each said nut is threaded onto said threaded shank of a respective one of said three bolts below a respective one of said second set of washers.

18. A collapsible tripod stool as recited in claim 1, further including a carrying case to hold said collapsible tripod stool therein when placed into the closed position.

19. A collapsible tripod stool as recited in claim 18, further including a loop attached to said carrying case, so that a person can wear said carrying case on a waist belt.

20. A collapsible tripod stool as recited in claim 18, further including a shoulder strap attached to said carrying case, so that a person can support said carrying case from a shoulder.

21. A collapsible tripod stool comprising:

a) three legs, each of said three legs being telescopic and including an upper cylindrical segment, a lower cylindrical segment sized to slide fit within said upper cylindrical segment and a locking mechanism for retaining said lower cylindrical segment in an extended condition and a retracted condition with respect to said upper cylindrical segment, wherein said upper cylindrical segment of each of said three legs having an aperture adjacent a lower end at one of three U-shaped brackets, said lower cylindrical segment of each of said three legs having two holes, said first hole being located adjacent said bottom end and said second hole located adjacent a top end of said lower cylindrical segment of said one of said three legs and each of said locking mechanisms include a lever pivotally mounted on one of three arms of a respective Y-shaped axle, a pin on said lever extending through said aperture in said upper cylindrical segment and into one of said first and second holes of said lower cylindrical segment of said respective one of said three legs spring on said one arm of said Y-shaped axle for normally biasing said lever so that said pin will enter said aperture in said upper cylindrical segment and into one of said holes in said lower cylindrical segment of said respective one of said three legs until said lever is manually depressed to overcome a pressure of said spring on said lever;

b) means for crisscrossing said legs together, including said Y-shaped axle having said three arms; and said three U-shaped brackets, in which each said U-shaped bracket is secured upon one of said arms of said Y-shaped axle and fits about one said upper cylindrical segment of one said leg;

c) a flexible seat; and d) means for attaching said flexible seat onto flattened curved top ends of said legs, so that when said legs with said flexible seat are put in an open position and placed upon the ground a person can sit upon said flexible seat and when said legs with said flexible seat are put in a closed position, the person can comfortably carry it anywhere for any kind of outdoor activity.

* * * * *